US012305357B2

(12) United States Patent
Dauderman et al.

(10) Patent No.: US 12,305,357 B2
(45) Date of Patent: May 20, 2025

(54) IMPLEMENT CONTROL SYSTEM FOR MACHINE

(71) Applicant: DEERE & COMPANY, Moline, IL (US)

(72) Inventors: Bradley C. Dauderman, Dubuque, IA (US); Cory J. Brant, Hazel Green, WI (US); Nathan J. Horstman, Durango, IA (US)

(73) Assignee: DEERE & COMPANY, Moline, IL (US)

( * ) Notice: Subject to any disclaimer, the term of this patent is extended or adjusted under 35 U.S.C. 154(b) by 1360 days.

(21) Appl. No.: 16/917,104

(22) Filed: Jun. 30, 2020

(65) Prior Publication Data

US 2021/0404142 A1 Dec. 30, 2021

(51) Int. Cl.
*E02F 3/84* (2006.01)
*E02F 3/76* (2006.01)

(52) U.S. Cl.
CPC ..... *E02F 3/7618* (2013.01); *E02F 3/844* (2013.01)

(58) Field of Classification Search
CPC ..... E02F 3/845; E02F 3/7618; E02F 3/841; E02F 3/432; E02F 3/842; E02F 8/847; E02F 3/844; E02F 3/7631; E02F 3/7627; E02F 9/265; E02F 3/437
See application file for complete search history.

(56) References Cited

U.S. PATENT DOCUMENTS 3,726,428 A * 4/1973 Lark ..... E02F 3/432 414/700
4,332,517 A * 6/1982 Igarashi ..... E02F 3/437 701/50
5,002,454 A * 3/1991 Hadank ..... E02F 9/2025 74/471 XY
5,015,123 A * 5/1991 Houck ..... E02B 11/00 405/36
5,052,883 A * 10/1991 Morita ..... E02F 3/433 60/426
5,356,260 A * 10/1994 Ikari ..... E02F 3/433 414/700
5,467,829 A * 11/1995 Barton ..... E02F 3/432 172/826

(Continued)

FOREIGN PATENT DOCUMENTS

DE 102019219159 A1 6/2020
DE 102019219174 A1 6/2020
WO WO2018136889 A1 7/2018

OTHER PUBLICATIONS

German Search Report issued in application No. DE102021113894.9 dated Mar. 17, 2022 (04 pages).

*Primary Examiner* — Edwin J Toledo-Duran
(74) *Attorney, Agent, or Firm* — Michael Best & Friedrich LLP

(57) ABSTRACT

A machine is configured to travel on a ground surface. The machine includes a frame and a support coupled to the frame. The support is configured to be raised or lowered relative to the frame. The machine also includes an implement movably coupled to the support. The implement is configured to engage the ground surface. The machine further includes a control processor configured to move the implement in response to movement of the support.

17 Claims, 6 Drawing Sheets

(56) References Cited

U.S. PATENT DOCUMENTS 5,974,352 A * 10/1999 Shull ..... E02F 3/432 701/50
6,312,596 B1 * 11/2001 Kunzelman ..... B01D 17/0202 210/924
6,757,994 B1 * 7/2004 Hendron ..... E02F 3/432 701/50
7,222,444 B2 * 5/2007 Hendron ..... E02F 3/432 37/414
7,293,376 B2 * 11/2007 Glover ..... E02F 3/432 701/50
8,103,417 B2 * 1/2012 Gharsalli ..... E02F 3/844 318/587
8,548,690 B2 * 10/2013 Hayashi ..... E02F 3/847 701/50
9,328,479 B1 * 5/2016 Rausch ..... E02F 9/265
9,624,643 B2 * 4/2017 Hendron ..... E02F 3/847
9,752,300 B2 * 9/2017 Chang ..... E02F 3/7627
10,030,354 B1 7/2018 Dean
10,119,244 B2 11/2018 Elkins
10,865,542 B2 * 12/2020 Smith ..... E02F 3/432
11,629,476 B2 * 4/2023 Zhao ..... E02F 3/7645 172/818
2002/0162668 A1 * 11/2002 Carlson ..... E02F 9/26 172/1
2006/0096137 A1 * 5/2006 Hendron ..... E02F 3/964 37/348
2006/0104786 A1 * 5/2006 Shepherd ..... E02F 3/436 414/699
2008/0263908 A1 * 10/2008 Schoenmaker ..... E02F 9/2041 711/100
2008/0313935 A1 * 12/2008 Trifunovic ..... E02F 9/2004 37/413
2011/0046857 A1 * 2/2011 Farmer ..... E02F 3/845 701/50
2011/0153170 A1 * 6/2011 Dishman ..... E02F 9/2029 701/50
2011/0213529 A1 * 9/2011 Krause ..... E02F 3/431 701/50
2012/0152575 A1 * 6/2012 Hand ..... F15B 13/043 701/50
2015/0330057 A1 * 11/2015 Faivre ..... E02F 3/844 701/50
2017/0275848 A1 * 9/2017 Marquette ..... E02F 9/265
2018/0094409 A1 * 4/2018 Davis ..... E02F 9/262
2019/0226176 A1 * 7/2019 Smith ..... E02F 3/432
2019/0330820 A1 * 10/2019 Bellows ..... B66C 13/40
2020/0048863 A1 2/2020 Faivre et al.
2020/0263390 A1 * 8/2020 Raj ..... E02F 3/437
2020/0354921 A1 * 11/2020 Nishi ..... E02F 9/123
2021/0010239 A1 * 1/2021 Ono ..... E02F 9/2041
2021/0025140 A1 * 1/2021 Daley ..... E02F 9/2285
2021/0156122 A1 * 5/2021 Vanderlinde ..... E02F 9/265
2021/0318713 A1 * 10/2021 Case ..... E02F 3/841
2022/0010521 A1 * 1/2022 Izumikawa ..... E02F 9/2045
2023/0092265 A1 * 3/2023 Kean ..... E02F 9/262 37/348

* cited by examiner

IMPLEMENT CONTROL SYSTEM FOR MACHINE

FIELD OF THE DISCLOSURE

The present disclosure relates to a machine including an implement that engages a ground surface, and more particularly to a control system for controlling the implement of the machine.

SUMMARY

In one aspect, a machine is configured to travel on a ground surface. The machine includes a frame and a cab coupled to the frame. The cab includes a boom control member and an implement control member. The cab is configured to support an operator of the machine. The machine includes a boom pivotably coupled to the frame about a first pivot axis and a first hydraulic actuator coupled to the boom and the frame. The first hydraulic actuator is configured to move the boom about the first pivot axis in response to the operator actuating the boom control member. The machine includes an implement pivotably coupled to the boom about a second pivot axis. The implement is configured to engage the ground surface. The machine includes a second hydraulic actuator coupled to the implement and the boom. The second hydraulic actuator is configured to move the implement about the second pivot axis in response to the operator actuating the implement control member. The machine includes a control processor configured to automatically move the first and second hydraulic actuators in response to the operator actuating the boom control member.

In another aspect, a machine is configured to travel on a ground surface. The machine includes a frame and a support coupled to the frame. The support is configured to be raised or lowered relative to the frame. The machine also includes an implement movably coupled to the support. The implement is configured to engage the ground surface. The machine further includes a control processor configured to move the implement in response to movement of the support.

In yet another aspect, a control system is configured to be in communication with a machine. The control system includes a control processor configured to move a support of the machine relative to a frame of the machine in response to an operator of the machine actuating a first control member, move an implement of the machine relative to the support in response to the operator actuating a second control member, and move the implement relative to the support proportional to the movement of the support relative to the frame. The implement is configured to engage a ground surface supporting the machine.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and being practiced or being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
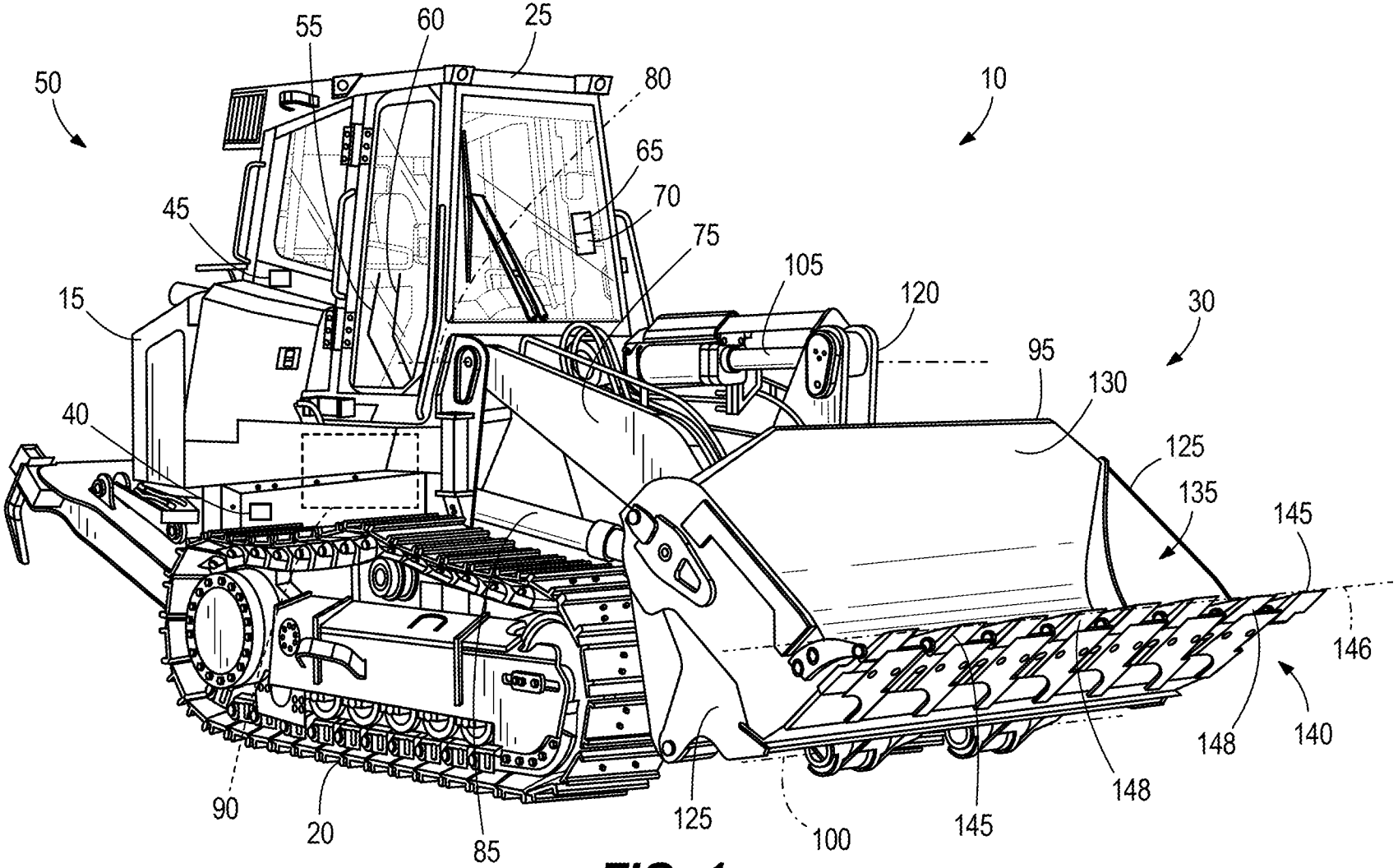
FIG. 1 is a perspective view of a machine including a boom coupled to a frame of the machine and an implement coupled to the boom.

FIG. 1 illustrates a machine 10 including a frame 15, traction members 20 coupled to the frame 15, a cab 25 coupled to the frame 15, and an implement assembly 30 coupled to the frame 15. In the illustrated embodiment, the machine 10 is a crawler loader including the traction members 20 as two continuous tracks that support the machine 10 on a ground surface 35 (FIG. 2) and enable movement of the machine 10 relative to the ground surface 35. In other embodiments, the traction members 20 can be wheels or a combination of wheels and continuous tracks. An inertial measurement unit 40 is also coupled to the frame 15 and is operable to measure an orientation of the frame 15 relative to gravity to, for example, determine if the machine 10 is moving uphill, downhill, on a flat surface, etc. The inertial measurement unit 40 is in communication with a control processor 45 of a control system 50 of the machine 10. In further embodiments, the machine 10 can be a different type of machine (e.g., skid-steer loader, a grader, a backhoe loader, a bulldozer, etc.).

The illustrated cab 25 supports an operator of the machine 10 and includes a boom control lever 55 (e.g., a first control member) and an implement control lever 60 (e.g., a second control member) that are in communication with the control processor 45 to control the implement assembly 30. The cab 25 also includes a first actuator 65 and a second actuator 70 positioned within the cab 25 and are also in communication with the control processor 45. The first and/or second actuators 65, 70 can be buttons, switches, inputs on a user interface display, etc. that enable different programs of the control processor 45 to automatically control the implement assembly 30, discussed in more detail below.

Figure 2:
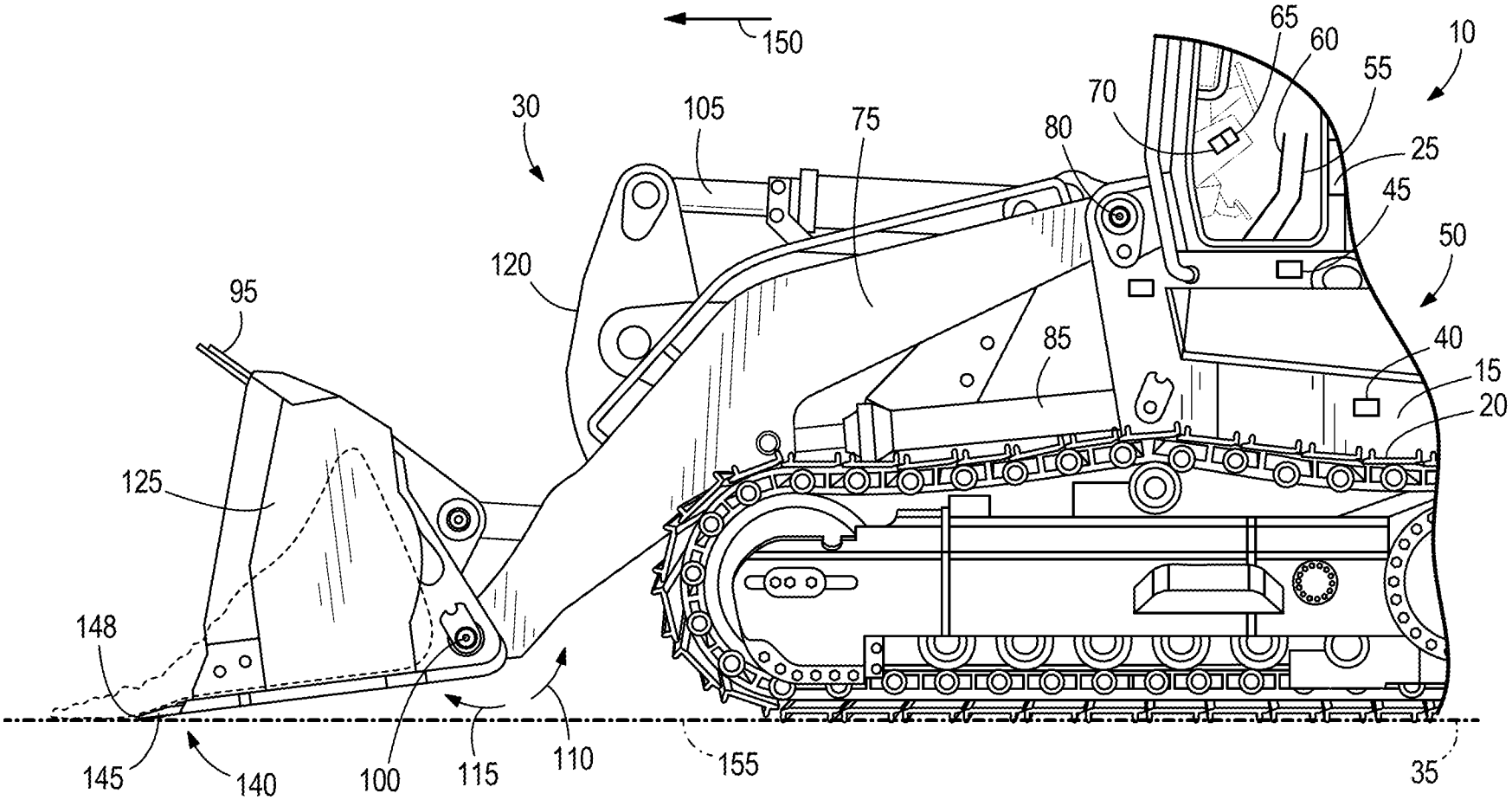
FIG. 2 is a partial side view of the machine of FIG. 1 illustrating the boom and the implement in a first position during a filling operation of the machine.

With continued reference to FIG. 1, the illustrated implement assembly 30 includes a boom 75 (e.g., a support) pivotably coupled to the frame 15 about a boom axis 80 and a boom hydraulic actuator 85 (e.g., a first hydraulic cylinder) coupled to the boom 75 and the frame 15. The boom hydraulic actuator 85 is fluidly coupled to a hydraulic pump 90 (via a hydraulic control valve), which is in communication with the control processor 45. The hydraulic pump 90 and the hydraulic control valve are operable to control the boom hydraulic actuator 85 to either raise the boom 75 about the boom axis 80 relative to the frame 15 or lower the boom 75 about the boom axis 80 relative to the frame 15. The illustrated implement assembly 30 also includes an implement 95 pivotably coupled to the boom 75 about an implement axis 100 and an implement hydraulic actuator 105 (e.g., a second hydraulic cylinder) coupled between the implement 95 and the boom 75. The implement hydraulic actuator 105 is also fluidly coupled to the hydraulic pump 90 (via the hydraulic control valve) such that the hydraulic pump 90 and the hydraulic control valve are operable to control the implement hydraulic actuator 105 to either rotate the implement 95 in a first direction 110 (e.g., a downward tilt direction; FIG. 2) about the implement axis 100 or rotate the implement 95 in a second direction 115 (e.g., an upward tilt direction; FIG. 2) about the implement axis 100. In the illustrated embodiment, the implement assembly 30 includes a linkage 120 between the implement hydraulic actuator 105 and the implement 95 to provide additional leverage to move the implement 95 about the implement axis 100. In other embodiments, the linkage 120 can be omitted such that the implement hydraulic actuator 105 can be coupled to the implement 95 and the boom 75.

The illustrated implement 95 is a bucket including side walls 125 and a support wall 130 extending between the side walls 125 to define a cavity 135 that receives and supports material (e.g., dirt, rock, etc.). The support wall 130 includes a bottom edge portion 140 having teeth 145 operable to dig into material or the ground surface 35. The illustrated edge portion 140 extends between the two side walls 125 of the implement 95 and is defined by a linear line 146 extending through tips 148 of the teeth 145 (FIG. 1). In other embodiments, a bottom edge of the support wall 130 can be curved such that the edge portion 140 is a curved edge portion and the line 146 is a curved line extending between the two side walls 125. In further embodiments, the teeth 145 can be omitted such that the edge portion 140 is the bottom edge of the support wall 130. In yet further embodiments, the implement 95 can be a different implement (e.g., a grading blade, a trench cutter, etc.).

Figure 3:
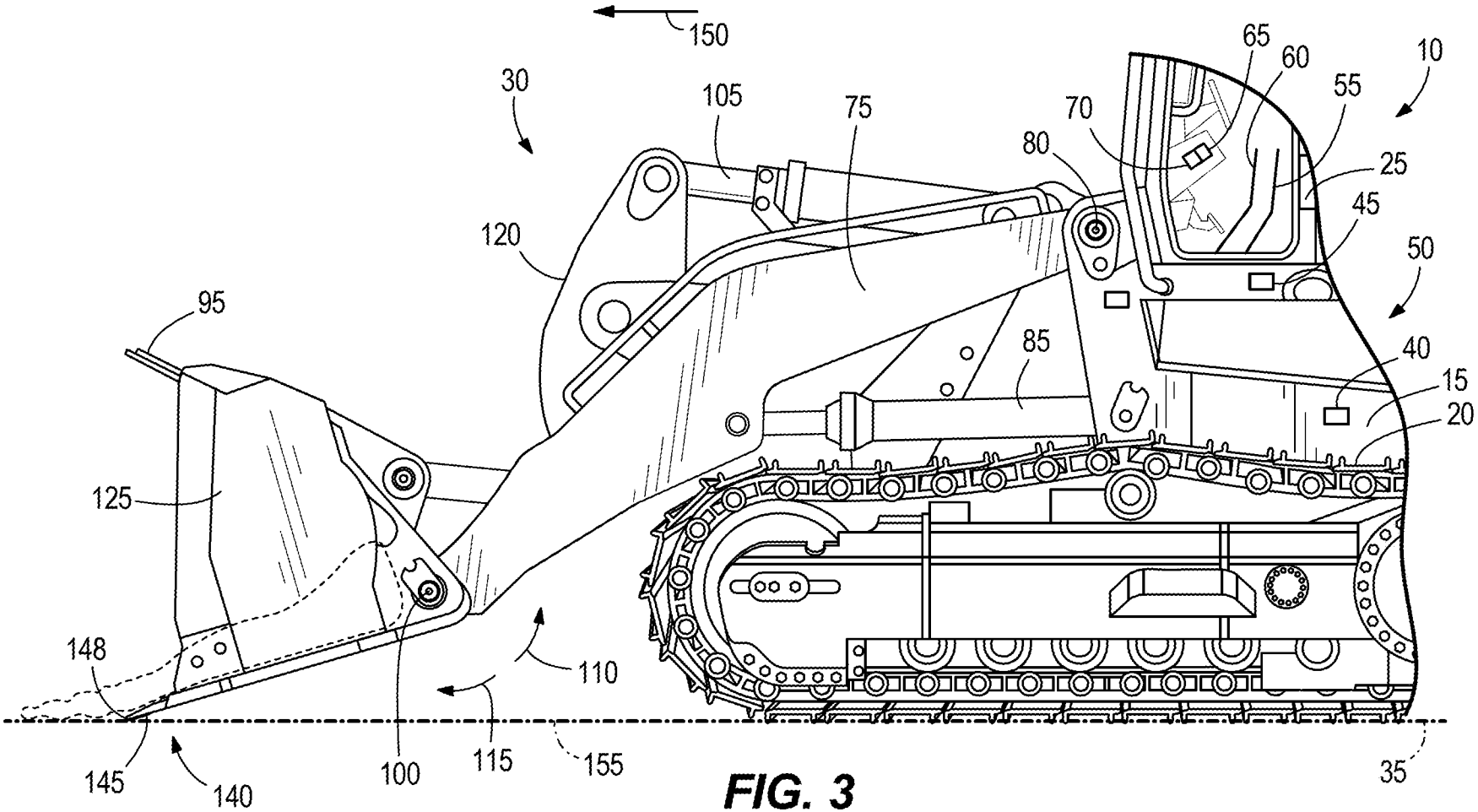
FIG. 3 is a partial side view of the machine of FIG. 1 illustrating the boom and the implement in a second position during the filling operation of the machine.

The machine 10 can perform various different tasks. For example, FIGS. 2 and 3 illustrate the machine 10 during a filling operation. In general, the filling operation includes discharging material (e.g., soil, sand, rock, etc.) from the implement 95 to fill in depressions/holes in the ground surface 35 to reach a desired grade of the ground surface 35. Conventionally, the operator of the machine 10 moves the machine 10 in a forward direction 150 and manually controls the boom and implement control levers 55, 60 to raise/lower the boom 75 and tilt the implement 95 to desired positions relative to the frame 15 to control the amount of material being discharged from the implement 95 onto the ground surface 35. This technique can lead to inconsistent discharge of material from the implement 95 as the operator continuously balances the operation of the boom and implement control levers 55, 60 to reach the desired grade of the ground surface 35.

The illustrated control system 50 is operable to increase the consistency of the material being discharged from the implement 95 during a filling operation while the machine 10 is moving in the forward direction 150. In operation, the operator actuates the first actuator 65 within the cab 25 for the control system 50 to couple movement of the implement hydraulic actuator 105 with the boom hydraulic actuator 85. In particular, once the first actuator 65 is enabled, the operator controls the movement of the implement 95 relative to the boom 75 via manipulating the boom control lever 55. As such, when the operator manipulates the boom control lever 55 to move the boom 75 relative to the frame 15, the control processor 45 automatically moves the implement 95 relative to the boom 75 without any further input from the operator. In other words, input from the operator on the boom control lever 55 moves the implement 95 relative to the boom 75 in response to movement of the boom 75 relative to the frame 15. In the illustrated embodiment, as the operator raises the boom 75 (FIG. 2 to FIG. 3), the control processor 45 automatically moves the implement 95 in the first direction 110. Conversely, as the operator lowers the boom 75 (FIG. 3 to FIG. 2), the control processor 45 automatically moves the implement 95 in the second direction 115. Moreover, the control system 50 moves the implement 95 relative to the boom 75 proportional to the movement of the boom 75 relative to the frame 15. For example, for about every degree the boom 75 moves about the boom axis 80, the implement 95 moves between about 0.1 of a degree and about 0.9 of a degree. In other words, the control system 50 moves the implement 95 about the implement axis 100 at a smaller angular degree than a particular angular movement of the boom 75 about the boom axis 80. In some embodiments, the implement control lever 60 is still enabled to control movement of the implement 95 relative to the boom 75 when the first actuator 65 is enabled. In further embodiments, the cab 25 can include a third control lever—separate from the boom and implement levers 55, 60—that moves the implement 95 relative to the boom 75 in response to movement of the boom 75 relative to the frame 15.

With continued reference to FIGS. 2 and 3, the control system 50 couples the movement of the boom 75 and the implement 95 such that the edge portion 140 of the implement 95 is maintained in a position relative to a plane 155. In particular, the line 146 of the edge portion 140 is maintained substantially within the plane 155. In other embodiments, a portion of the line 146 (e.g., when the line 146 is curved) can be maintained within the plane 155. The illustrated plane 155 is defined by the contact between the traction members 20 and the ground surface 35. To maintain the edge portion 140 relative to the plane 155, the control system 50 determines a position of the boom 75 relative to the frame 15 via a sensor coupled to the boom hydraulic actuator 85 (e.g., to measure an amount to which the actuator 85 is extended/retracted), and determines a position of the implement 95 relative to the boom 75 via a sensor coupled to the implement hydraulic actuator 105 (e.g., to measure an amount to which the actuator 105 is extended/retracted). Accordingly, the position of the edge portion 140 relative to the plane 155 can be determined by monitoring the extended/retracted positions of the actuators 85, 105. Movement of the implement 95 relative to the boom 75 and movement of the boom 75 relative to the frame 15 can be substantially simultaneous to maintain the edge portion 140 of the implement 95 relative to the plane 155.

By maintaining the edge portion 140 of the implement 95 relative to the plane 155, the operator can more easily and accurately control the amount of material being discharged from the implement 95 such that the operator can more easily and accurately control the desired grade. For example, with a relatively full load of material in the implement 95 (FIG. 2), the operator can keep the implement 95 at a shallow angle relative to the ground surface 35 to slowly discharge material from the implement 95. As the machine 10 moves in the forward direction 150, the implement 95 pushes the material into depressions/holes within the ground surface 35 to form the desired grade. In other words, the edge portion 140 sets the grade and the implement 95 carries the filling material while the machine 10 moves in the forward direction 150. As the material in the implement 95 decreases (FIG. 3), the operator can maintain the amount of the material being discharged from the implement 95 by simply controlling the boom control lever 55 to increase the tilt angle of the implement 95 (e.g., moves the implement 95 in the first direction 110) and raise the boom 75. Conversely, the operator can decrease the amount of material being discharged from the implement 95 by simply controlling the boom control lever 55 to decrease the tilt angle of the implement 95 (e.g., move the implement 95 in the second direction 115) and lower the boom 75. Accordingly, the operator can more easily control the desired grade of the ground surface 35 by the control system 50 maintaining the edge portion 140 relative to the plane 155 while the operator controls the amount of material being discharged from the implement 95.

In some embodiments, the control system 50 can include an adjustment feature to offset the edge portion 140 of the implement 95 away from the plane 155 at a desired distance in a direction perpendicular to the plane 155 (e.g., maintain the position of the edge portion 140 a few inches above the ground surface 35). The adjustment feature can be controlled by a dial, a knob, a user display interface, etc. within the cab 25.

Figure 4:
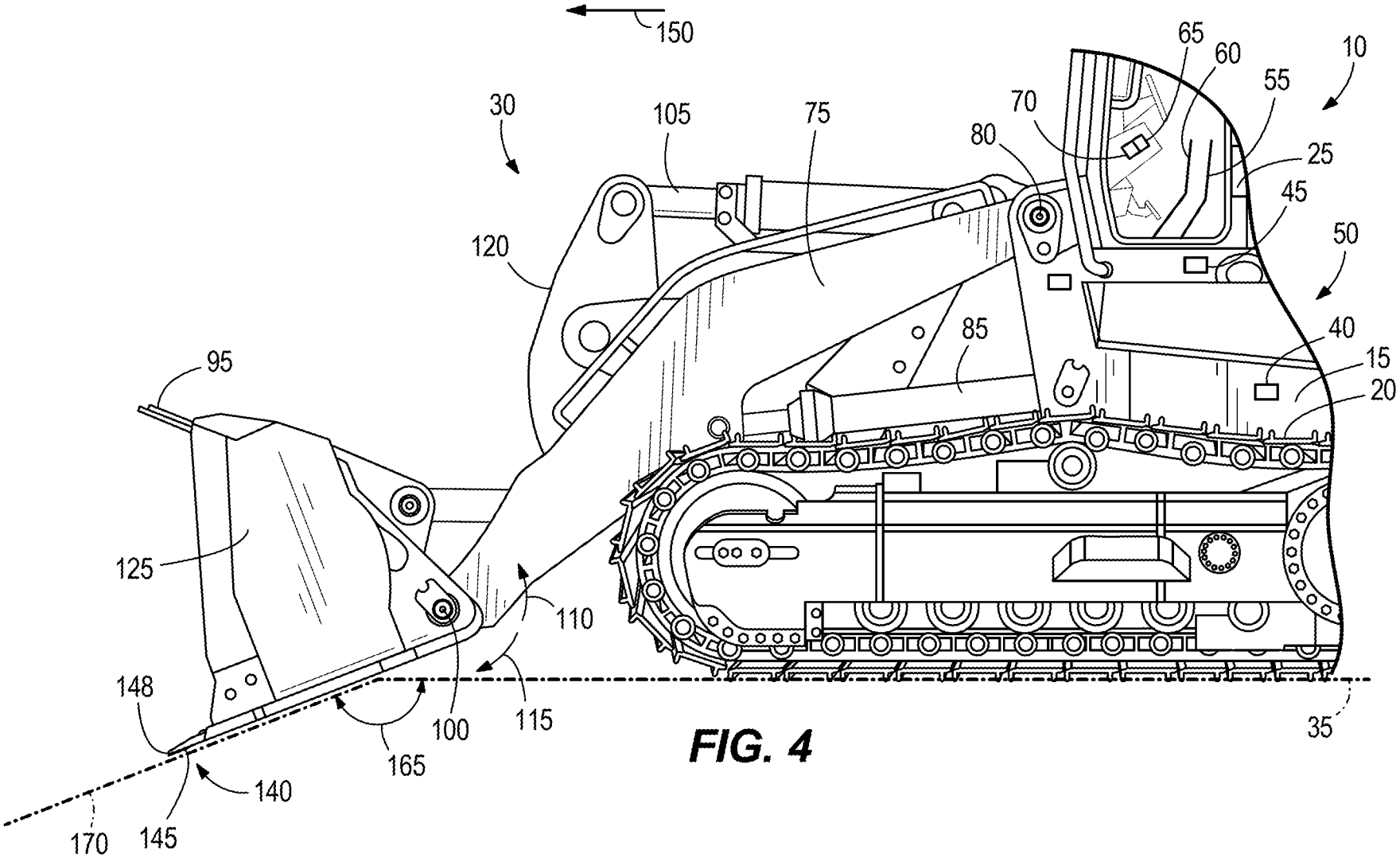
FIG. 4 is a partial side view of the machine of FIG. 1 illustrating the machine in a first position during a cutting operation.
Figure 5:
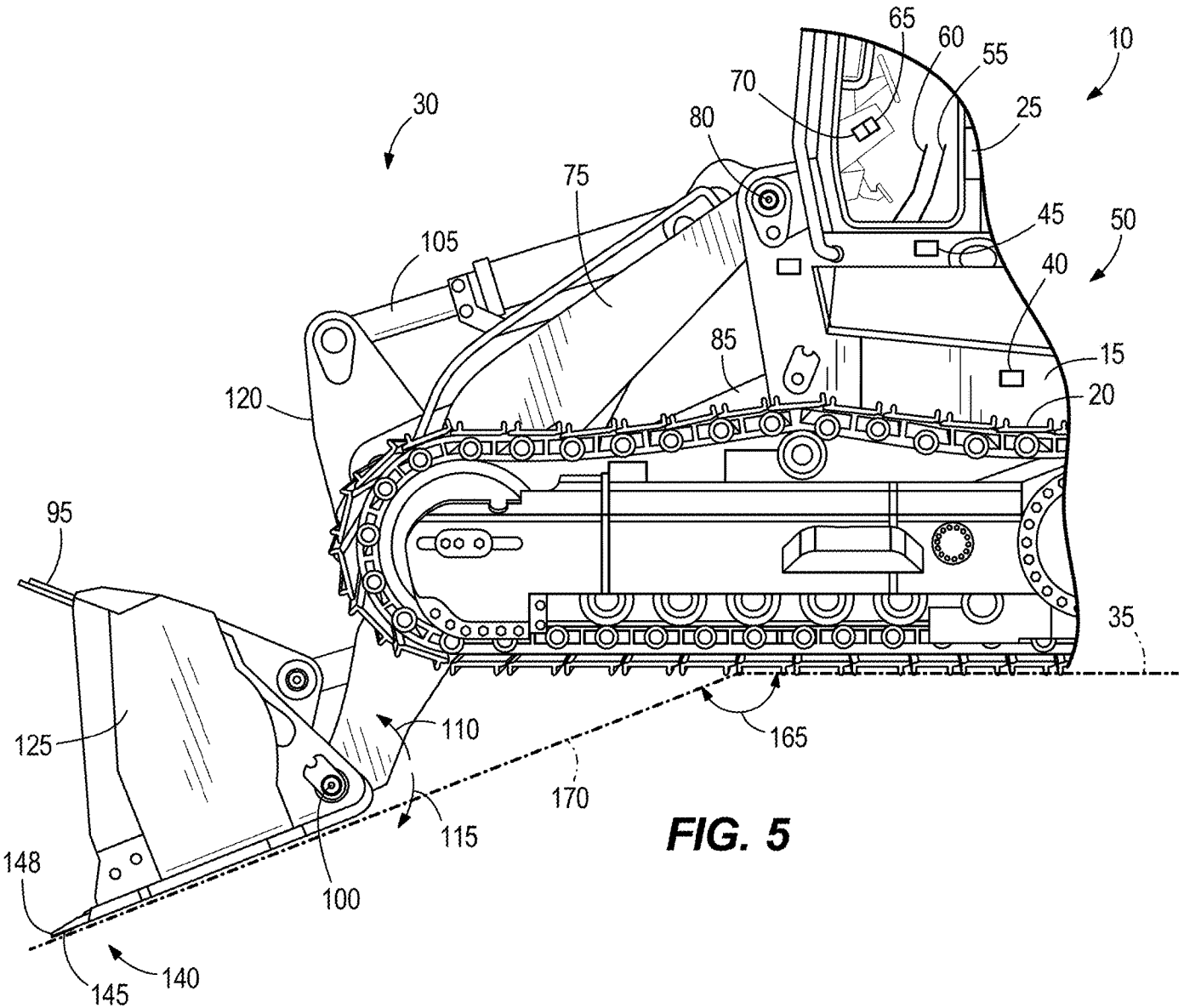
FIG. 5 is a partial side view of the machine of FIG. 1 illustrating the machine in a second position during the cutting operation.
Figure 6:
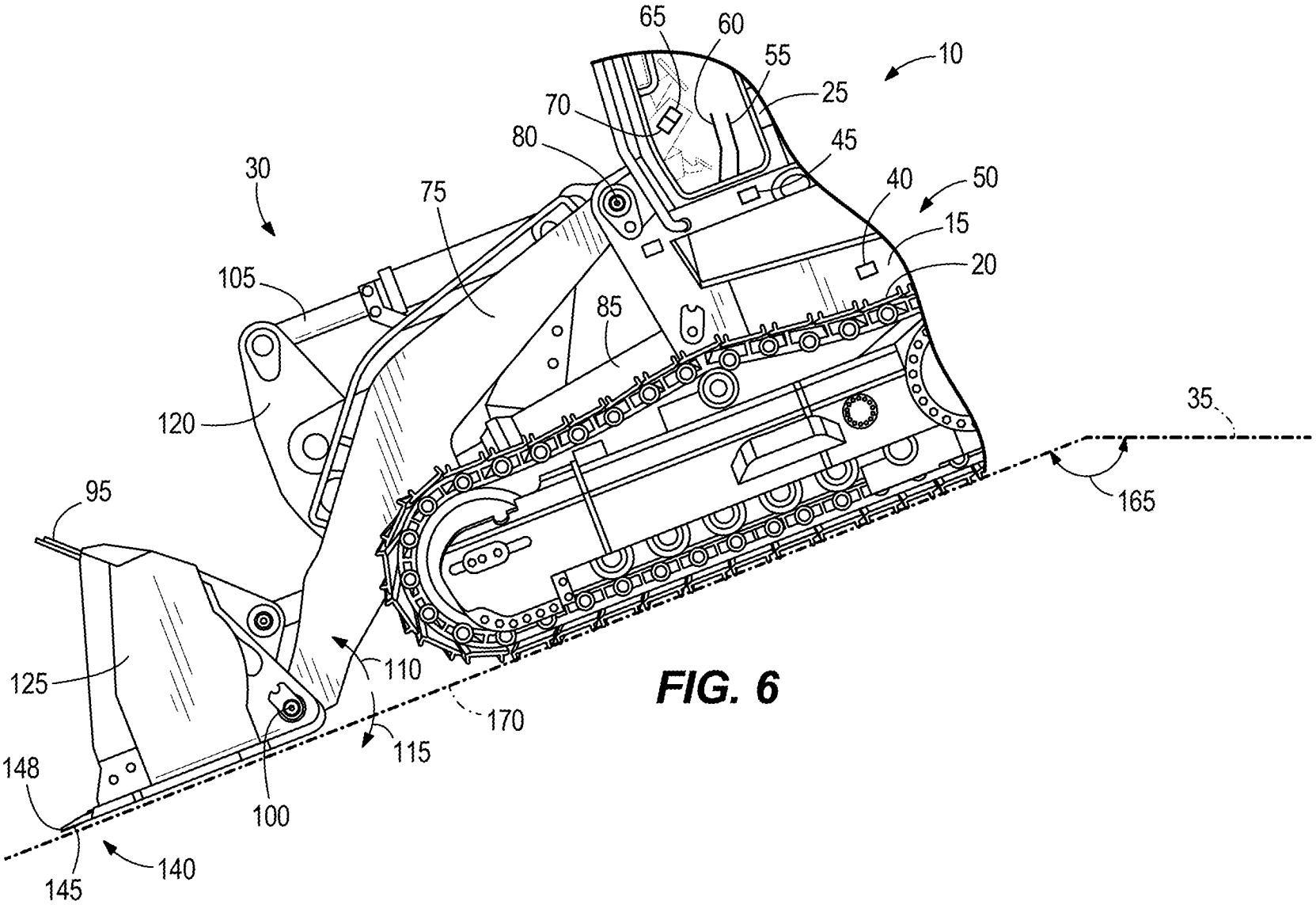
FIG. 6 is a partial side view of the machine of FIG. 1 illustrating the machine in a third position during the cutting operation.

FIGS. 4-6 illustrate the machine 10 during a cutting operation in which the machine 10 moves in the forward direction 150 and the implement 95 cuts into the ground surface 35. For example, the operator of the machine 10 may desire to cut into the ground surface 35 at a grade angle 165 (e.g., a two-degree grade angle, a five-degree grade angle, etc.) and to accurately maintain the grade angle 165 for a certain duration. The second actuator 70 allows the operator to communicate with the control processor 45 to set a desired cutting operation. For example, the operator inputs the desired grade angle 165 with the second actuator 70, and as a result, the control system 50 automatically moves the boom 75 and the implement 95 relative to the ground surface 35 such that as the machine 10 moves in the forward direction 150, the implement 95 cuts into the ground surface 35 at the desired grade angle 165 (FIG. 4). As the machine 10 continues to move in the forward direction 150 (FIG. 5), the control system 50 automatically lowers the boom 75 relative to the frame 15 and automatically tilts the implement 95 in the second direction 115 to maintain the grade angle 165. With reference to FIG. 6, once the traction members 20 of the machine 10 move onto a downslope 170 of the ground surface 35, the frame 15 of the machine 10 changes orientation relative to gravity and the inertial measurement unit 40 measures the change. The control processor 45 receives a signal from the inertial measurement unit 40 representative of the machine 10 positioned on the downslope 170. As such, the control system 50 again automatically moves the boom 75 relative to the frame 15 and the implement 95 relative to the boom 75 to maintain the grade angle 165 as the machine 10 now travels on the downslope 170. Accordingly, the control system 50 maintains the grade angle 165 as the machine 10 moves in the forward direction 150 without any operator input on the boom and implement control levers 55, 60.

Although the disclosure has been described in detail with reference to certain preferred embodiments, variations and modifications exist within the scope and spirit of one or more independent aspects of the disclosure as described. Various features and advantages of the disclosure are set forth in the following claims.

The invention claimed is:

1. A machine configured to travel on a ground surface, the machine comprising:

a frame;

a cab coupled to the frame and including a boom control member and an implement control member, the cab configured to support an operator of the machine;

a boom pivotably coupled to the frame about a first pivot axis;

a first hydraulic actuator coupled to the boom and the frame, the first hydraulic actuator configured to move the boom about the first pivot axis in response to the operator actuating the boom control member;

an implement pivotably coupled to the boom about a second pivot axis, the implement configured to engage the ground surface and configured to hold material;

a second hydraulic actuator coupled to the implement and the boom, the second hydraulic actuator configured to move the implement about the second pivot axis in response to the operator actuating the implement control member; and a control processor configured to automatically move the first and second hydraulic actuators in response to the operator actuating the boom control member during a filling operation of the machine, wherein the filling operation includes moving the machine forward or rearward and discharging the material from the implement onto the ground surface, and wherein the implement is a bucket configured to hold material, and wherein the control processor is configured to automatically move the first and second hydraulic actuators in response to the operator actuating the boom control member, such that movement of the bucket relative to the boom is proportional to movement of the boom relative to the frame in response to the operator actuating the boom control member.

2. The machine of claim 1, further comprising traction members coupled to the frame and configured to contact the ground surface such that a plane is defined by the contact between the traction members and the ground surface, wherein the traction members are configured to move the machine relative to the ground surface, and wherein during the filling operation the control processor is configured to maintain at least a portion of an edge of the bucket within the plane during movement of the first and second hydraulic actuators.

3. The machine of claim 2, wherein the control processor is configured to offset the portion of the edge from the plane and to maintain the portion of the edge at a desired distance from the plane, and wherein the desired distance is measured perpendicular to the plane.

4. The machine of claim 1, wherein the frame includes an inertial measurement device configured to measure an orientation of the frame relative to gravity, wherein the control processor is in communication with the inertial measurement device, wherein the control processor is configured to move the second hydraulic actuator in response to a signal from the inertial measurement device during a cutting operation of the machine, and wherein the cutting operation includes moving the machine forward and cutting into the ground surface with the bucket.

5. A machine configured to travel on a ground surface, the machine comprising:

a frame;

a support coupled to the frame, the support configured to be raised or lowered relative to the frame;

an implement movably coupled to the support, the implement configured to engage the ground surface;

a support control member actuable by an operator, and a control processor configured to move the implement in response to movement of the support, such that movement of the implement relative to the support is proportional to movement of the support relative to the frame in response to the operator actuating the support control member, wherein the support control member is a first control member, wherein the support is configured to be raised or lowered in response to an operator of the machine actuating the first control member, wherein the implement is configured to move relative to the support in response to the operator actuating a second control member, and wherein during a filling operation the control processor is configured to move the implement in response to the movement of the support when the operator actuates the first control member.

6. The machine of claim 5, further comprising traction members coupled to the frame and configured to contact the ground surface such that a plane is defined by the contact between the traction members and the ground surface, wherein the traction members are configured to move the machine relative to the ground surface, and wherein the control processor is configured to maintain at least a portion of an edge of the implement within the plane during movement of the support and the implement.

7. The machine of claim 6, wherein the control processor is configured to offset the portion of the edge from the plane and to maintain the portion of the edge at a desired distance from the plane, and wherein the desired distance is measured perpendicular to the plane.

8. The machine of claim 6, wherein the traction members are continuous tracks.

9. The machine of claim 5, wherein the control processor is configured to move the implement and the support simultaneously relative to the frame in response to the operator actuating the support control member.

10. The machine of claim 5, wherein the support is movably coupled to the frame by a first hydraulic actuator, and wherein the implement is movably coupled to the support by a second hydraulic actuator.

11. The machine of claim 5, wherein the implement is a bucket pivotably coupled to the support.

12. The machine of claim 11, wherein the control processor is configured to move the bucket relative to the support in response to the operator actuating the support control member during a filling operation of the machine, and wherein the filling operation includes moving the machine forward or rearward and discharging material from the bucket onto the ground surface.

13. The machine of claim 11, wherein the frame includes an inertial measurement device configured to measure an orientation of the frame relative to gravity, wherein the control processor is in communication with the inertial measurement device, wherein the control processor is configured to move the bucket relative to the support in response to a signal from the inertial measurement device during a cutting operation of the machine, and wherein the cutting operation includes moving the machine forward and cutting into the ground surface with the bucket.

14. A control system configured to be in communication with a machine, the control system comprising:

a control processor configured to move a support of the machine relative to a frame of the machine in response to an operator of the machine actuating a first control member, move an implement of the machine relative to the support in response to the operator actuating a second control member, the implement configured to engage a ground surface supporting the machine, and move the implement relative to the support proportional to the movement of the support relative to the frame in response to an operator of the machine actuating a first control member, wherein the control processor is in communication with an inertial measurement device coupled to the machine, wherein the control processor is configured to move the implement in response to a signal from the inertial measurement device during a cutting operation of the machine, and wherein the cutting operation includes moving the machine forward and cutting into the ground surface with the implement.

15. The control system of claim 14, wherein the control processor is configured to maintain at least a portion of an edge of the implement within a plane during movement of the support and the implement, and wherein the plane is defined by contact between traction members of the machine and the ground surface.

16. The control system of claim 15, wherein during a filling operation the control processor is configured to offset the portion of the edge from the plane and to maintain the portion of the edge at a desired distance from the plane, and wherein the desired distance is measured perpendicular to the plane.

17. The control system of claim 14, wherein the control processor is configured to move the implement proportional to the movement of the support during a filling operation of the machine, and wherein the filling operation includes moving the machine forward or rearward and discharging the material from the implement onto the ground surface.

* * * * *